US007726247B2

(12) United States Patent
Neland

(10) Patent No.: US 7,726,247 B2
(45) Date of Patent: Jun. 1, 2010

(54) BOAT AND AUTOMOBILE STORAGE APPARATUS

(76) Inventor: Richard L. Neland, 2916 River Point Dr., Daytona Beach, FL (US) 32118

( * ) Notice: Subject to any disclaimer, the term of this patent is extended or adjusted under 35 U.S.C. 154(b) by 805 days.

(21) Appl. No.: 11/561,381

(22) Filed: Nov. 17, 2006

(65) Prior Publication Data

US 2008/0101882 A1 May 1, 2008

Related U.S. Application Data

(60) Provisional application No. 60/862,981, filed on Oct. 25, 2006.

(51) Int. Cl.
*B65D 19/44* (2006.01)

(52) U.S. Cl. ..... 108/55.1; 108/55.3; 414/286; 114/44

(58) Field of Classification Search ..... 108/51.11, 108/55.3, 55.1, 54.1; 410/3, 6, 7, 9; 211/182; 280/414.1; 414/280, 281, 254, 264, 260, 414/255, 286; 248/346.02; 206/386
See application file for complete search history.

(56) References Cited

U.S. PATENT DOCUMENTS 1,841,066 A * 1/1932 Simning ..... 410/7
2,285,232 A 6/1942 Sheehan
2,819,801 A 1/1958 Winkler
2,936,985 A * 5/1960 Doerr et al. ..... 108/55.1
3,014,602 A 12/1961 Gronvold
3,033,390 A 5/1962 Gronvold
3,178,216 A * 4/1965 Huber ..... 108/55.1
3,189,198 A 6/1965 Filak
3,385,458 A 5/1968 Gresham
3,786,942 A 1/1974 Dane, Jr.
4,142,637 A 3/1979 Kraiss
4,190,013 A * 2/1980 Otis et al. ..... 414/264
4,307,985 A * 12/1981 Desprez et al. ..... 248/346.02
4,516,506 A * 5/1985 Paton ..... 410/57
4,705,289 A * 11/1987 Weber ..... 280/414.1
4,726,316 A 2/1988 Bruns
4,869,634 A 9/1989 Carter
4,946,332 A * 8/1990 Daniels ..... 280/414.1
4,979,869 A 12/1990 Mullin, Jr.
5,011,357 A 4/1991 Studler (Continued)

FOREIGN PATENT DOCUMENTS

WO WO 03/025315 A1 3/2003

(Continued)

*Primary Examiner*—José V Chen
(74) *Attorney, Agent, or Firm*—Christopher Wood; Daniel Eisenberg; Wood & Eisenberg, PLLC

(57) ABSTRACT

A dual-use automobile-boat storage pallet, having a structural support framework of generally rectangular shape with first and second side members and a plurality of cross-members. The storage pallet includes an apparatus for holding a boat that is width adjustable and height adjustable and includes a plurality of folding bunks that are mounted on and supported by two or more of the cross-members. The storage pallet includes an apparatus for holding a car, which includes a first automobile tread plate and a second automobile tread plate supported by the first and second side members of the structural support framework. The dual-use automobile storage pallet can include an optional pair of forklift tine guides.

18 Claims, 10 Drawing Sheets

U.S. PATENT DOCUMENTS 5,140,787 A 8/1992 Corcoran
5,487,636 A * 1/1996 Mkrtchyan ..... 414/286
5,704,756 A * 1/1998 Marteney et al. ..... 414/462
5,755,472 A * 5/1998 Clive-Smith ..... 108/55.1
5,833,289 A * 11/1998 Brolin ..... 108/55.1
6,007,288 A 12/1999 Maffett et al.
6,217,053 B1 * 4/2001 Forsythe et al. ..... 280/414.1
6,615,742 B1 * 9/2003 Swanson ..... 108/55.5
6,923,138 B2 * 8/2005 Holbrook ..... 280/414.1
7,112,007 B2 * 9/2006 Maffett et al. ..... 405/3
7,194,971 B2 * 3/2007 Stolzer ..... 114/44
7,367,747 B2 * 5/2008 Maffett et al. ..... 405/1
7,380,809 B2 * 6/2008 McGinty et al. ..... 280/414.1
7,402,017 B2 * 7/2008 Stolzer ..... 414/281
2002/0009346 A1 * 1/2002 Holt et al. ..... 410/94
2002/0039526 A1 4/2002 Jokinen
2002/0176767 A1 11/2002 Gisselberg
2004/0265096 A1 12/2004 James

FOREIGN PATENT DOCUMENTS

WO WO 2005/073074 A2 8/2005

* cited by examiner

BOAT AND AUTOMOBILE STORAGE APPARATUS

CROSS-REFERENCE TO RELATED APPLICATIONS

This application claims the benefit of priority from U.S. Provisional Patent Application Ser. No. 60/862,981, filed Oct. 25, 2006, the entire contents of which are incorporated herein by reference.

STATEMENT REGARDING FEDERALLY SPONSORED RESEARCH OR DEVELOPMENT

Not Applicable.

FIELD OF THE INVENTION

This invention relates to storage systems. More specifically, the invention is directed to automobile and boat dual storage dual systems. Still more specifically, the invention is directed to a vastly improved automobile/boat storage pallet.

BACKGROUND OF THE INVENTION

A marina is typically a dock or basin that provides secure moorings for pleasure boats such as powerboats and frequently offers ground facilities such as parking lots. Where demand for moorings is particularly high, boats such as powerboats are stored on land, but space is frequently at a premium particularly at popular marinas located on prime water front properties. When space is at a premium it is difficult to provide adequately sized parking lots to meet the parking needs of boat owners. Thus, there is a need for meeting the needs and expectations of both marine owners and boat users.

Of particular interest is U.S. Pat. No. 5,011,357, issued to Studler, which describes a space-saving boat and automobile parking system for marinas uniquely utilizing a pallet for sequential storage of either a boat or an automobile whereby land and space requirements for vehicular parking are significantly diminished. In operation, a boat owner telephones his/her marina a predetermined time before his/her scheduled arrival for boat use. The marina operator then takes a lift truck to the owner's assigned "pigeon coop" storage space, inserts the fork tines into a boat-supporting pallet according to the invention, lifts the pallet up from its supports and moves the pallet to a launching area, lowers the pallet into the water until the boat floats, and then removes the pallet. The pallet is then taken to an automobile loading station, the owner's automobile is driven onto the pallet, secured as desired, and the lift truck then takes the auto and pallet to the assigned nest position and deposits the pallet with the automobile thereat.

Furthermore, the patent application publication US 20020039526 A1 to Jokinen shows a garage that has increased parking capacity for vehicles. A parking level has water filling the parking structure so that boats or floating platforms may fill the parking level. The only passageway needed is that which will accommodate the boats or platforms. Vehicles entering the garage are driven onto an endless belt and this belt drives the vehicle onto a platform having another endless belt. When exiting the vehicle's belt drives it off the platform to an exit area. Multiple levels accommodate even larger capacity garages. A computer can control entry, exit, and movement of the platforms to random locations and/or to elevators in multiple level garages.

In addition, the U.S. Pat. No. 3,786,942, issued to Dane, Jr., describes a dry sail marina for storing small to moderately sized boats out of the water with means for transferring them automatically between storage points and the water. The marina is contained within a building having a center aisle extending the length thereof and a series of vertically stacked racks bounding each side of the aisle. Boats are stored in sling by boat cars housed in the racks. An overhead traveling crane with a hoist suspended track assembly rides along the center aisle between any storage point and the waterside of the marina. The track assembly is adapted to connect with any rack and includes transport means for coupling to individual cars and wheeling them onto and off of the track assembly. To deliver a boat, the track assembly is connected up with the assigned rack and the transport means draws the car with boat in sling onto the track assembly. The loaded track assembly is then transported to the water by the overhead crane whereupon it is lowered and the boat is deposited in the water and released from its car. The crane then returns the boat car to the rack by a reverse procedure.

None of the above inventions and patents, taken either singly or in combination, is seen to describe the instant invention as claimed.

SUMMARY OF THE INVENTION

A dual-use automobile-boat storage pallet, having a structural support framework of generally rectangular shape with first and second side members and a plurality of cross-members. The storage pallet includes a means for holding a boat that is width adjustable and height adjustable and includes a plurality of folding bunks that are mounted on and supported by two or more of the cross-members. The storage pallet includes a means for holding a car, which includes a first automobile tread plate and a second automobile tread plate supported by the first and second side members of the structural support framework. The dual-use automobile storage pallet also includes an optional pair of forklift tine guides.

BRIEF DESCRIPTION OF THE DRAWINGS

Similar reference characters denote corresponding features consistently throughout the attached drawings.

DETAILED DESCRIPTION OF THE INVENTION

Figure 1:
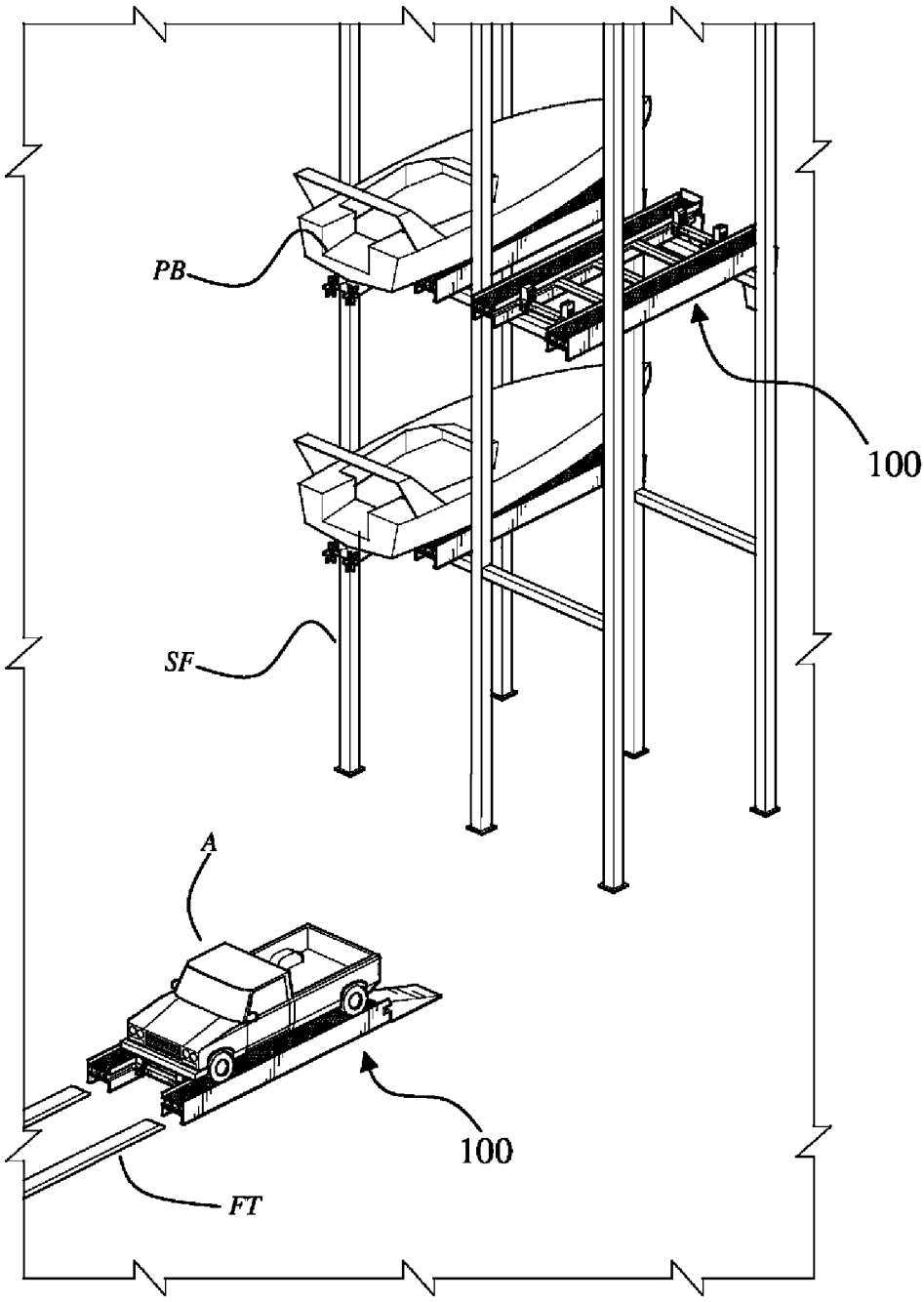
FIG. 1 is a perspective environmental view of a dual-use automobile-boat storage pallet according to the present invention.

This invention relates to storage systems. More specifically, the invention is directed to automobile and boat dual storage dual systems. Still more specifically, the invention is directed to a vastly improved dual-use automobile/boat storage pallet. The dual-use automobile/boat storage pallet of the invention is denoted generally by the numeric label "100". The terms "automobile-boat storage pallet 100" and "dual-use pallet 100" are regarded as equivalent terms.

Referring to the FIGURES in general, the dual-use automobile-boat storage pallet 100 comprises a structural support framework 120, a plurality of folding bunks 140, a first automobile tread plate 160 and a second automobile tread plate 180, and an optional pair of tine guides (specifically, first forklift tine guide 200 and a second forklift tine guide 220). The structural support framework 120 has an overall rectangular shape and comprises a first side member 240, a second side member 260, and a plurality of cross-members 280. The plurality of folding bunks 140 are used to support a powerboat PB, the folding bunks 140 are height adjustable and are mounted on the plurality of cross-members 280.

The first 160 and second 180 automobile tread plates are respectively supported by first 240 and second 260 side members. Optional hinged ramp plates 300 and 320 together with optional flanged extensions 340 and 360 are respectively fitted to one end of the automobile tread plates 160 and 180. The hinged ramp plates 300 and 320 are optionally pivoted such that when the automobile-boat storage pallet 100 is lifted by a forklift truck from the ground the hinged ramp plates 300 and 320 hinge downwards and whereupon extensions 340 and 360 may serve as automobile wheel stops. Portable car ramps (not shown) such as car loading ramps available from automobile accessory shops can be used in place of ramps plates 300, e.g., Oxlite products: "Series Heavy Duty Dual Runners", stock #13502 (5,000 lb load capacity) or stock #13702 (7,000 lb load capacity) supplied by Oxlite (Oxlite is located at: 1800 Rees Street, Breaux Bridge, La. 70517).

Regular wheel stops (not shown) can be fitted to first 160 and/or second 180 automobile tread plates. The tread plates 160 and 180 may be fabricated from any suitable material such as, but not limited to, aluminum or steel plates, and may include a roughened or embossed surface to minimize slippage of an automobile tire. The rest of the dual-use automobile-boat storage pallet 100 may be made of any suitable metal such as steel or aluminum.

Figure 4:
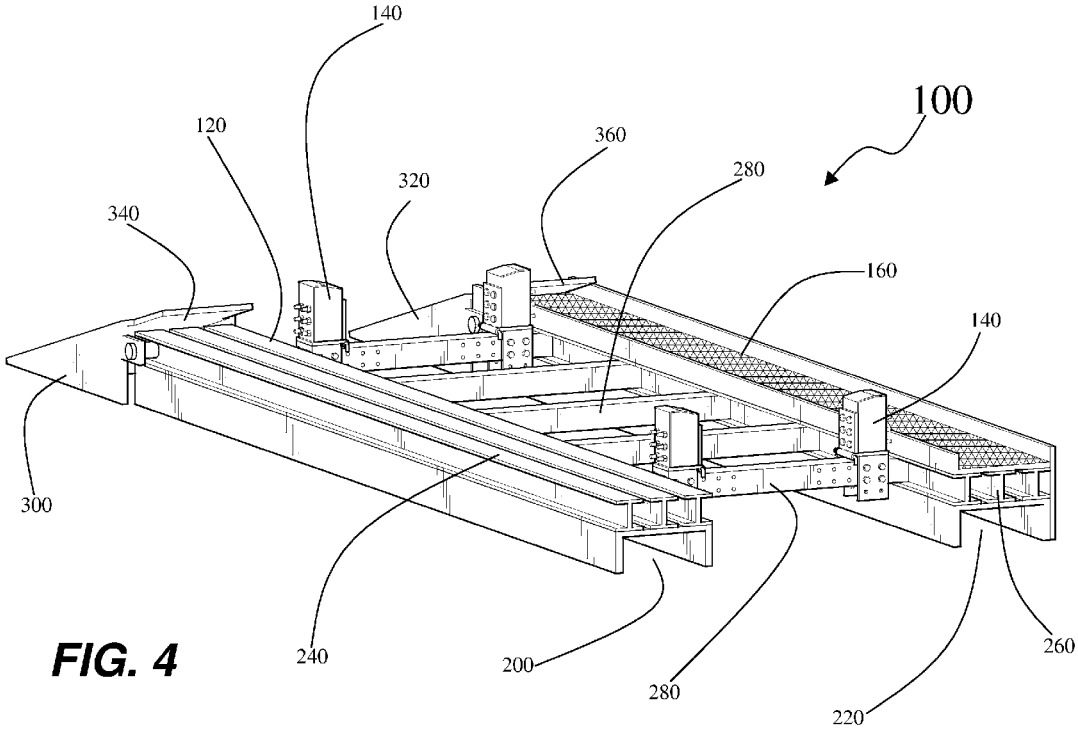
FIG. 4 shows an elevated view of a dual-use automobile-boat storage pallet with a tread plate removed.

The plurality of folding bunks 140 can be mounted in pairs on cross-members 280 as shown, for example, in FIG. 4. Alternatively, the plurality of folding bunks 140 can be mounted in any suitable manner so long as the folding bunks 140 can be folded down in the horizontal plane and folded up in the vertical plane to provide sufficient support to hold a powerboat PB safely and securely on the automobile-boat storage pallet 100. For example, the plurality of folding bunks 140 can be arranged such that there is one folding bunk per cross-member. The only issue is that there is sufficient symmetrical support given to both sides of a boat's keel. Bunks 140 fold downwards thus enabling an automobile A to drive onto the dual-use automobile-boat storage pallet 100 without colliding with the bunks 140.

Referring to the FIGURES of which FIG. 1 shows a perspective environmental view of the dual-use automobile-boat storage pallet 100. The dual-use automobile-boat storage pallet 100 is used to store an automobile A or powerboat PB. An automobile A is driven onto the dual-use automobile-boat storage pallet 100 and lifted by a forklift (represented by a pair of forklift tines FT) into a multilevel storage facility SF.

Figure 2:
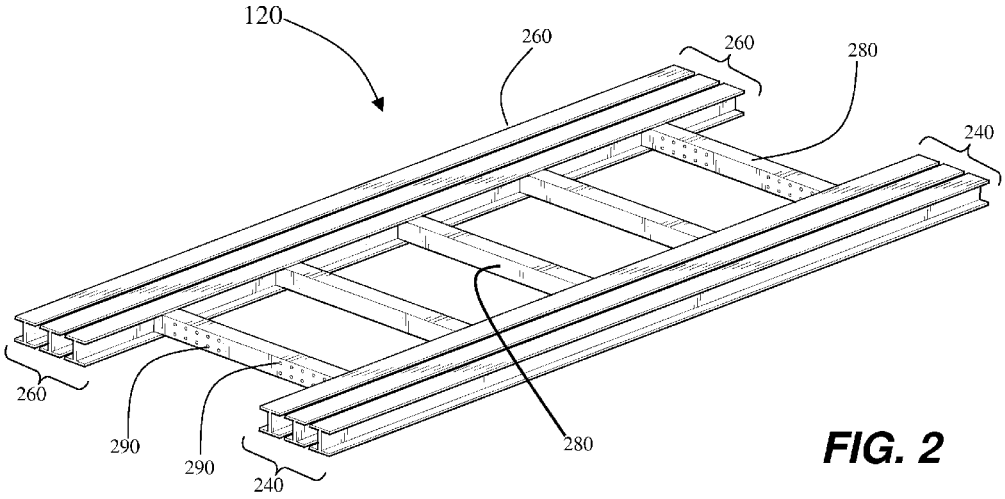
FIG. 2 is a perspective shows a perspective view of a structural support framework according to the present invention.

Referring to FIG. 2, which shows elements of the structural support framework 120. The structural support framework 120 has an overall rectangular shape and comprises a first side member 240, a second side member 260, and a plurality of cross-members 280. The first and second side members 240 and 260 can take any suitable form such as, but expressly not limited to, three I-beams welded together as shown in FIG. 2. A first set of apertures 290 is disposed in the horizontal plane through at least two cross-members 280. The first set of apertures 290 allows a worker to vary the lateral position of a folding bunk 140 to suit the particular shape of a powerboat's hull. Thus, the means for holding a powerboat is width adjustable, e.g., the horizontal distance d between folding bunks 140' and 140" (see FIG. 8) can be varied to suit a particular powerboat's hull shape (also see FIG. 7). Alternatively, when only one folding bunk 140 is mounted on a cross-beam 280 (see FIG. 6), the lateral position of the folding bunk 140 can be varied on the cross-beam 280 to suit the shape of a particular boat hull.

Figure 3:
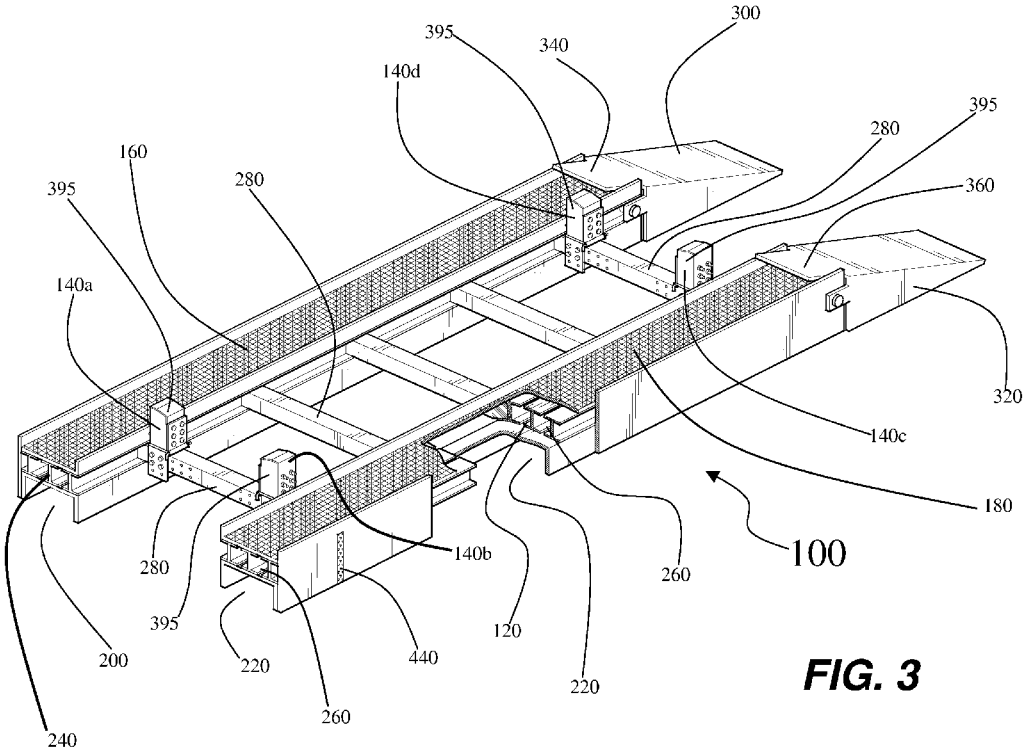
FIG. 3 is a perspective elevated view from the forklift end of a dual-use automobile-boat storage pallet according to the present invention.

Referring to FIGS. 3 and 4, of which FIG. 3 shows a perspective elevated view from the forklift end of the dual-use automobile-boat storage pallet 100. The forklift tines FT (shown in FIG. 1) are inserted in first and second forklift tine guides 200 and 220. FIG. 3 also shows a partial cutaway view to reveal the internal structure of second side member 260. FIG. 4 shows the automobile-boat storage pallet 100 with tread plate 180 removed to reveal the internal structure of second side member 240. FIG. 3 also shows an optional forklift guide in the form of a visible marker 440 is used to help guide a forklift operator in placing a loaded dual-use pallet 100 into the storage facility SF.

Figure 5:
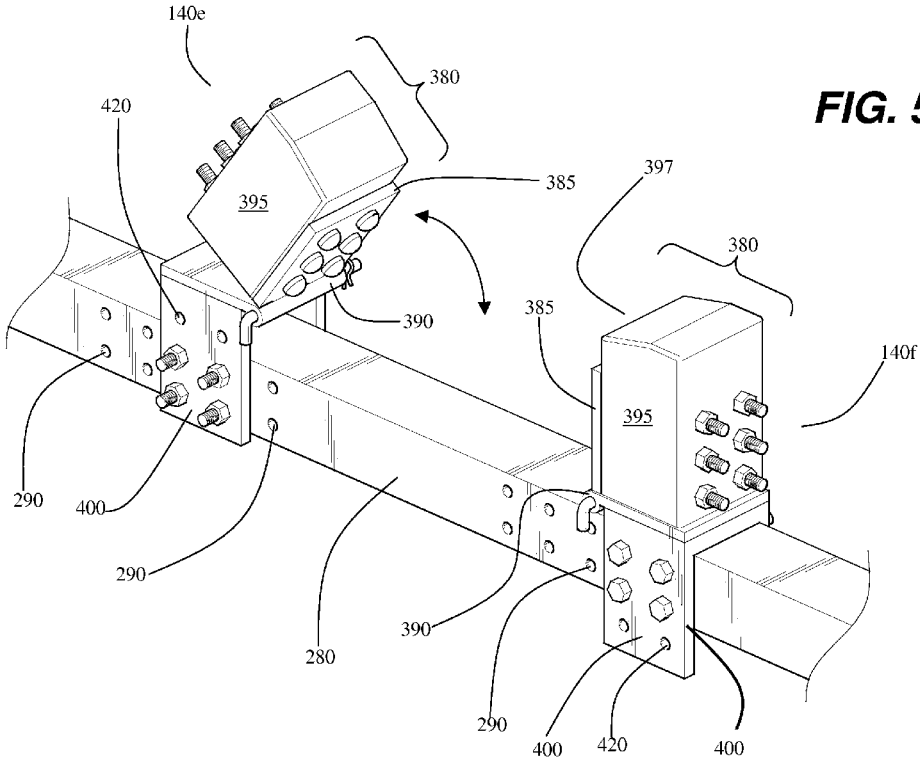
FIG. 5 shows a close up elevated view of two folding bunks according to the present invention.

Referring to FIG. 5, which shows a close up elevated view of two folding bunks 140 (represented by alphanumeric labels "140*e*" and "140*f*") affixed to crossbeam 280. The folding bunks 140 each comprise an upper section 380 and a lower section 400. The upper section 380 includes a bracket 385, a hinge member 390, and a boat-hull support member 395. The upper section 380 rests on, and is attached to, the lower section 400 (see FIG. 5). The hinge member 390 allows the bracket 385, and the boat-hull support member 395 attached to the bracket 385, to rotate through between about 80° and about 120° in the vertical plane to allow the upper section 380 to be folded up to take the load of a powerboat hull PBH as shown in, for example, FIG. 7 and out of the way prior to driving an automobile A onto the dual-use pallet 100 (see FIG. 1). Each boat-hull support member 395 defines a top end 397, which can be shaped to accommodate the hull of a boat. For example, the top end 397 can be beveled as shown in FIG. 5.

Still referring to FIG. 5, the lower section 400 takes the form of a U-shaped bracket that fits over the crossbeam 280. The lower section 400 defines a plurality of apertures 420 which are used to bolt the lower section 400 to the crossbeam 280. More specifically, the second set of apertures 420 are aligned with respect to at least some of the first set of apertures 290 and bolts are placed therethrough to secure the lower section 400 (and hence folding bunk 140) to crossbeam 280. The second set of apertures 420 are so arranged that each folding bunk 140 can be height adjusted. For illustration, folding bunk 140*e* is set higher with respect to crossbeam 280 than folding bunk 140*f* (see FIG. 5). The upper section 380 can be folded substantially flat with respect to crossbeam 280. Folding bunks 140 are used to support a powerboat hull PBH (see, e.g., FIG. 7).

It should be understood that each boat-hull support member 395 could have a different length. For example, in FIG. 3, the plurality of folding bunks 140 (represented by alphanumeric labels 140*a* through 140*c*) each comprise a boat-hull support member 395 having a generally square shaped cross-section such that each boat-hull support member 395 defines a generally square shaped pillar. The boat-hull support member 395 can adopt a more elongated appearance (see FIG. 9) resembling foldable pads with a length LE of between about 8 and 16 inches, and preferably about 12 inches. Alternatively, the boat-hull support member 395 can adopt a continuous elongated profile in the form of two elongated boat-hull support members each of which are approximately the length of the dual-use pallet 100 and hence supported by more than one cross member 280 as shown in FIG. 10.

Figure 6:
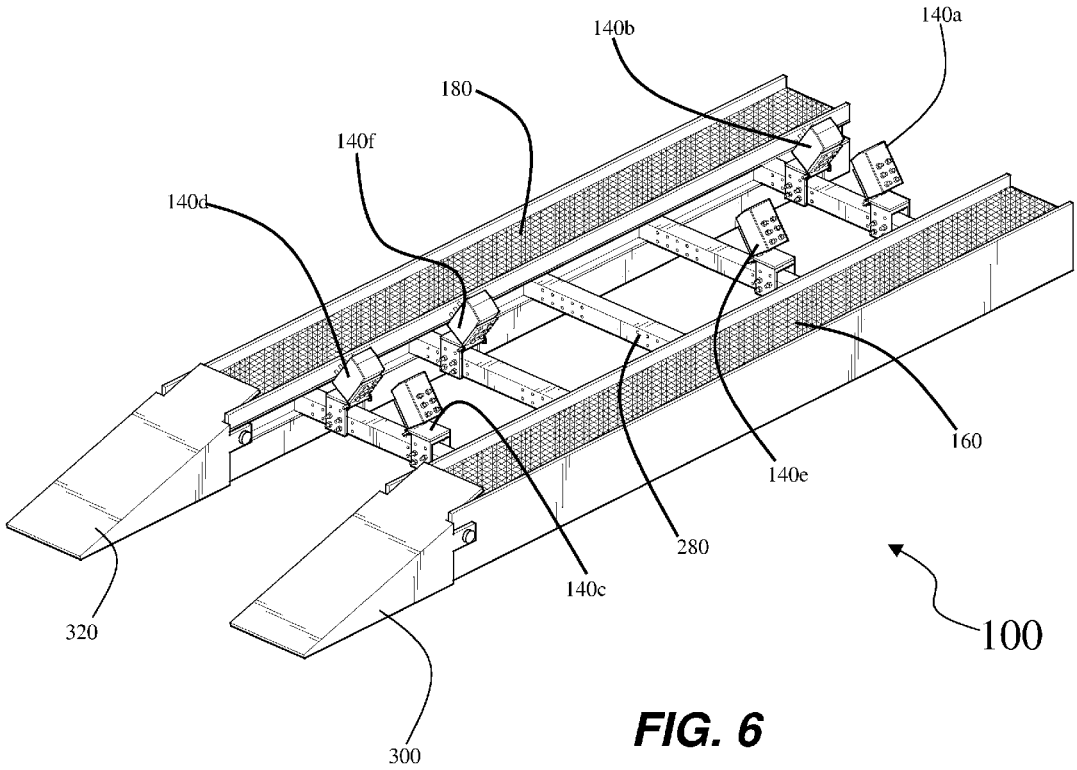
FIG. 6 shows six folding bunks fitted to four crossbeams.

FIG. 6 shows six folding bunks 140 (represented by alphanumeric labels 140*a* through 140*f*) fitted to four crossbeams 280. Two of the folding bunks 140 (represented by alphanumeric labels 140*e* and 140*f*) are shown in staggered formation thus demonstrating that the number and exact arrangement of folding bunks 140 fitted to the pallet 100 can vary. The only issue is that the folding bunks 140 are so arranged to provide sufficient support to hold a powerboat's hull.

Figure 7:
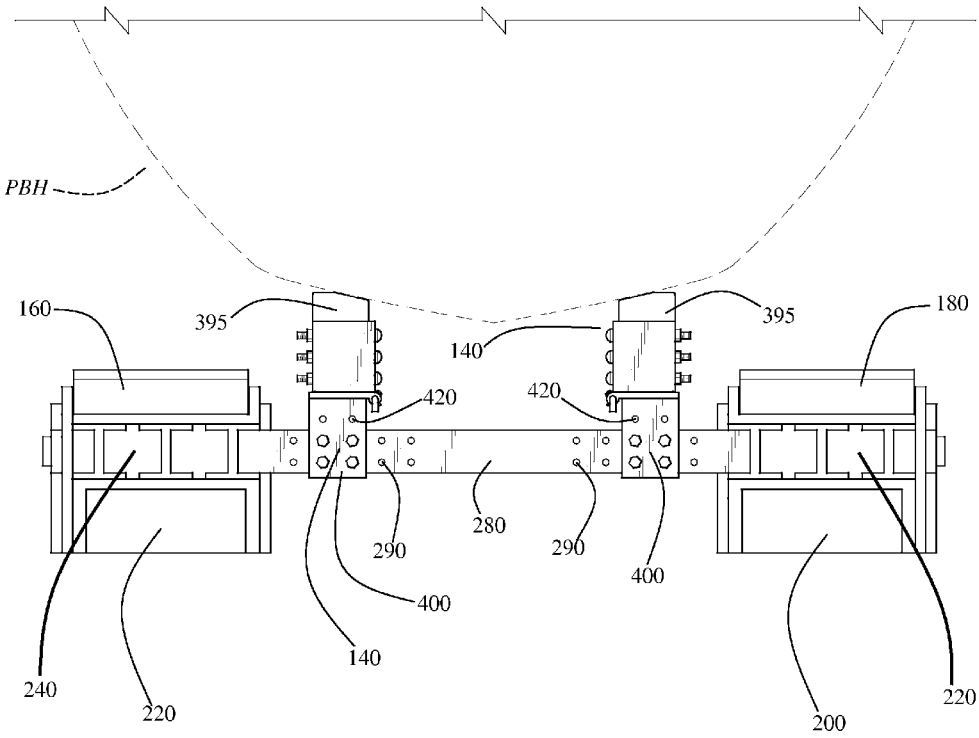
FIG. 7 shows an end view of the shows an end view of the automobile-boat storage pallet according to the invention.
Figure 8:
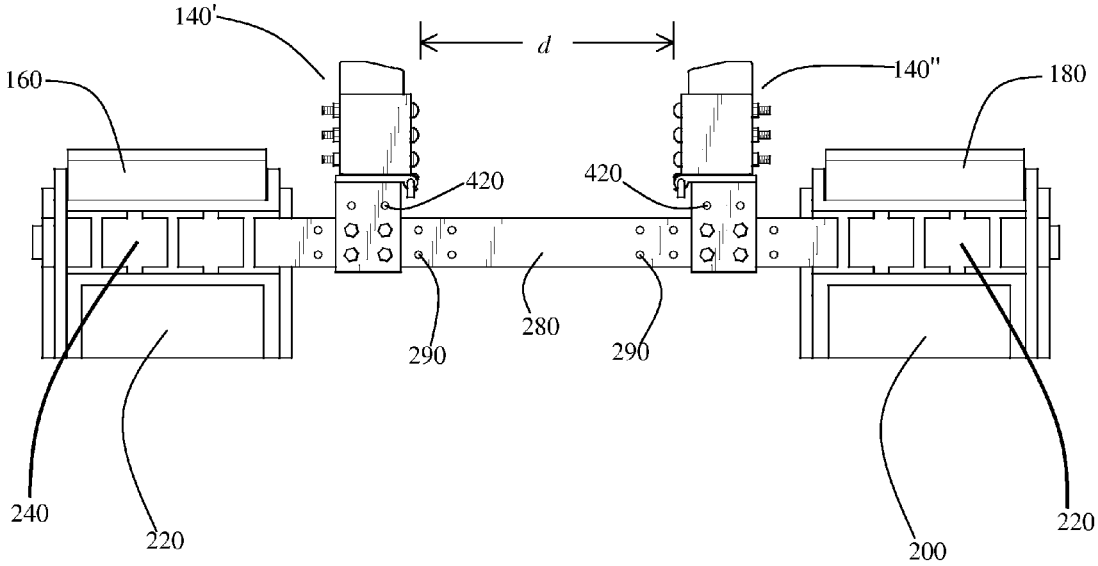
FIG. 8 shows an end view of the shows an end view of the automobile-boat storage pallet according to the invention.

Referring to FIGS. 7 and 8 of which FIG. 7 shows an end view of the pallet 100 holding a powerboat hull PBH. The horizontal distance d between folding bunks 140 (represented by labels 140' and 140") can be varied by moving folding bunk 140' and/or 140" along the crossbeam 280 taking care to align apertures 290 and 420 and passing securing bolts therethrough.

Figure 9:
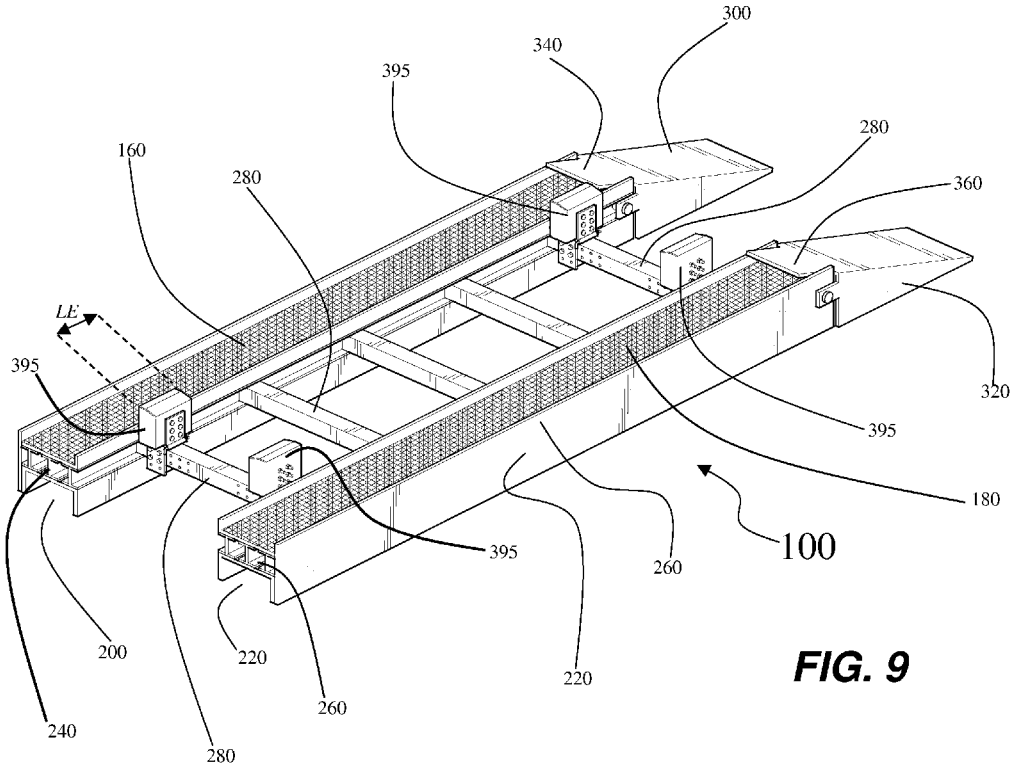
FIG. 9 shows an elevated view of a dual-use automobile-boat storage pallet according to the present invention.
Figure 10:
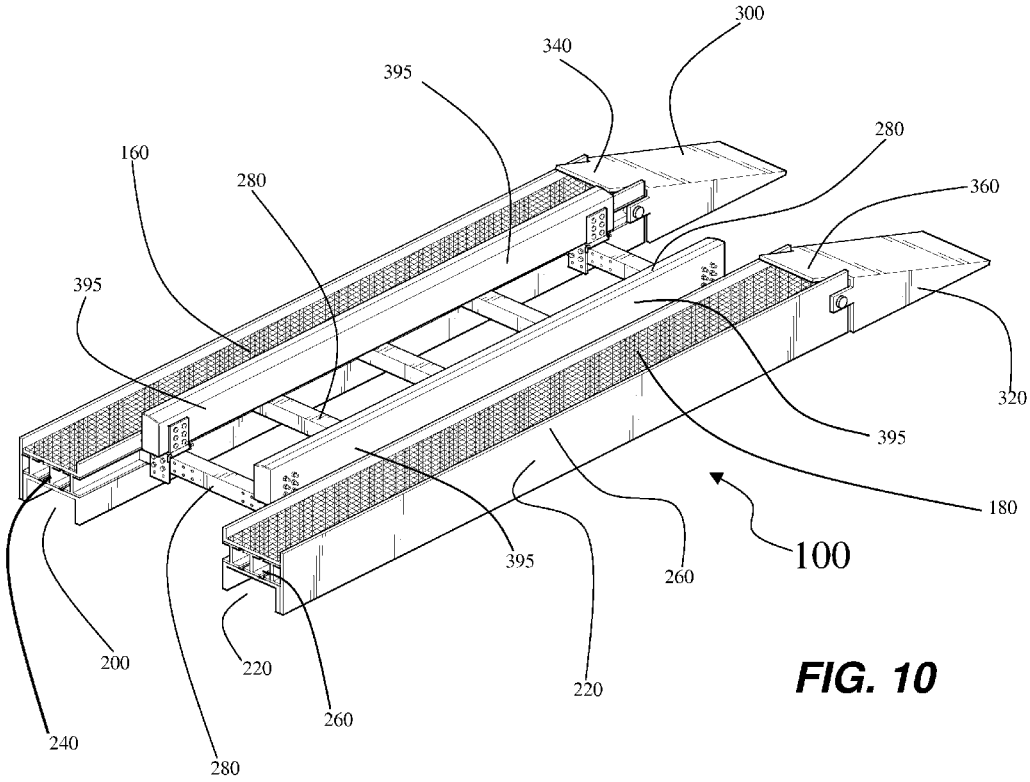
FIG. 10 shows an elevated view of a dual-use automobile-boat storage pallet according to the present invention.

FIG. 9 shows a dual-use pallet 100 fitted with boat-hull support member 395 with an elongated appearance resembling foldable pads with a length LE between about 8 and 16 inches in, and preferably about 12 inches.

FIG. 10 shows a dual-use pallet 100 fitted with two boat-hull support members 395 having a continuous elongated profile each of which are approximately the length of the dual-use pallet 100 and hence supported by more than one cross member 280. More preferably, the two boat-hull support members 395 have a length approximate to the length of the structural support framework 120 (shown in FIG. 2).

The dual-use automobile-boat storage pallet 100 provides an improved way of storing either boats or automobiles in multi-level structures thereby allowing marina owners to achieve greater use of limited space. For example, the flexibility of the bunks allows variously shaped boat hulls to be accommodated on the dual-use pallet 100. The folding capability of the bunks 140 allows vehicles with low chassis to be driven onto the dual-use pallet 100.

It is to be understood that the present invention is not limited to the embodiments described above, but encompasses any and all embodiments within the scope of the following claims.

I claim:

1. A dual-use automobile-boat storage pallet, comprising:

a structural support framework of overall rectangular shape comprising first and second side members and a plurality of cross-members, said cross-members extend laterally between said first and second side members, wherein the distance between said first and second side members accommodates to the width of an automobile, and the length of each said first and second side members are sufficient to accommodate the length of an automobile;

a means for holding a boat, wherein said means for holding a boat comprises a plurality of folding bunks hingedly mounted vertically on and supported by said cross-members, wherein said cross-members and said folding bunks comprise complementary sets of apertures for affixing said folding-bunks to the distance between the first and second side members is greater than when in the horizontal down position, wherein said cross-members and for adjusting the height and lateral positions of said folding bunks on said cross-members, said folding bunks move between a vertical up position and a horizontal down position, wherein in the vertical up position said folding bunks provide support to a boat and in the horizontal down position allow a car to be placed on said dual-use automobile-boat storage pallet; and a means for holding a car, wherein said means for holding a car comprises a first automobile tread plate and a second automobile tread plate, wherein said first and second automobile tread plates are respectively supported by said first and second side members of said structural support framework.

2. The dual-use automobile-boat storage pallet according to claim 1 further comprising a pair of forklift tine guides.

3. The dual-use automobile-boat storage pallet according to claim 1, wherein a hinged ramp plate is fitted to one end of each of said tread plates.

4. The dual-use automobile-boat storage pallet according to claim 1, wherein a pivoted hinged ramp plate in combination with a flanged extension is fitted to one end of each of said tread plates.

5. The dual-use automobile-boat storage pallet according to claim 1, wherein said plurality of folding bunks comprise two boat-hull support members having a continuous elongated profile each of which are approximately the length of the structural support framework.

6. The dual-use automobile-boat storage pallet according to claim 1, wherein said plurality of folding bunks comprise a plurality of boat-hull support members each having a length LE between about 8 and 16 inches.

7. The dual-use automobile-boat storage pallet according to claim 1, wherein said plurality of folding bunks comprise a plurality of boat-hull support members each having a length LE of about 12 inches.

8. The dual-use automobile-boat storage pallet according to claim 1, wherein said plurality of cross-members each define a first set of apertures, wherein said plurality of height adjustable folding bunks each define a second set of apertures, whereby aligning the first and second set of apertures enables the position of each of said plurality of folding bunks to be varied with respect to said plurality of cross-members.

9. A dual-use automobile-boat storage pallet, comprising:

a structural support framework of overall rectangular shape comprising first and second side members and a plurality of cross-members located between said first and second side members, wherein the distance between said first and second side members accommodates to the width of an automobile, and the length of each said first and second side members accommodates the length of an automobile;

a plurality of height adjustable folding bunks, wherein said plurality of folding bunks are mounted on and supported by said plurality of cross-members, the folding bunks each comprise an upper section and a lower section, the upper section includes a bracket, a hinge member and a boat-hull support member attached to the upper section bracket, the upper section rests on, and is attached to, the lower section, wherein the hinge member allows the upper section bracket and the boat-hull support member attached to the upper section bracket, to rotate through between about 80 degrees and about 120 degrees in the vertical plane to allow the upper section to be folded up so that when the upper section is folded up the distance between the first and second side members is decreased, so as to take the load of a powerboat hull, the lower section takes the form of a U-shaped bracket that fits over a crossbeam; and a means for holding a car, wherein said means for holding a car comprises a first automobile tread plate and a second automobile tread plate, wherein said first and second automobile tread plates are respectively supported by said first and second side members of said structural support framework.

10. The dual-use automobile-boat storage pallet according to claim 9 further comprising a pair of forklift tine guides.

11. The dual-use automobile-boat storage pallet according to claim 9, wherein said plurality of cross-members each define a first set of apertures, wherein said plurality of height adjustable folding bunks each define a second set of apertures, whereby aligning the first and second set of apertures enables the position of each of said plurality of folding bunks to be varied on said plurality of cross-members.

12. The dual-use automobile-boat storage pallet according to claim 9, wherein said plurality of folding bunks comprise two boat-hull support members having a continuous elongated profile each of which are approximately the length of the structural support framework.

13. The dual-use automobile-boat storage pallet according to claim 9, wherein said plurality of folding bunks comprise a plurality of boat-hull support members each having a length LE between about 8 and 16 inches.

14. The dual-use automobile-boat storage pallet according to claim 9, wherein said plurality of folding bunks comprise a plurality of boat-hull support members each having a length LE of about 12 inches.

15. The dual-use automobile-boat storage pallet according to claim 9, wherein a hinged ramp plate is fitted to one end of each of said tread plates.

16. The dual-use automobile-boat storage pallet according to claim 9, wherein a pivoted hinged ramp plate in combination with a flanged extension is fitted to one end of each of said tread plates.

17. A dual-use automobile-boat storage pallet, comprising:

a structural support framework of overall rectangular shape comprising first and second side members and a plurality of cross-members located between said first and second side members, wherein the distance between said first and second side members accommodated the width of an automobile, and the length of each said first and second side members accommodates the length of an automobile;

a plurality of height and width adjustable folding bunks, wherein said plurality of folding bunks are mounted on and supported by said plurality of cross-members, the folding bunks each comprise an upper section and a lower section, the upper section includes a bracket, a hinge member and a boat-hull support member attached to the upper section bracket, the upper section rests on, and is attached to, the lower section, wherein the hinge member allows the upper section bracket and the boat-hull support member attached to the upper section bracket, to rotate through between about 80 degrees and about 120 degrees in the vertical plane to allow the upper section to be folded up so that when the upper section is folded up the distance between the first and second side members is decreased, so as to take the load of a powerboat hull, the lower section takes the form of a U-shaped bracket that fits over a crossbeam;

a means for holding a car, wherein said means for holding a car comprises a first automobile tread plate and a second automobile tread plate, wherein said first and second automobile tread plates are respectively supported by said first and second side members of said structural support framework; and a pair of forklift tine guides fitted to said first and second side members.

18. The dual-use automobile-boat storage pallet according to claim 17 further comprising a visible marker (440), wherein said visual marker (440) serves as a guide for a forklift operator in placing said dual-use pallet into a storage facility.

* * * * *